US008157583B1

(12) United States Patent
Wei

(10) Patent No.: US 8,157,583 B1
(45) Date of Patent: Apr. 17, 2012

(54) TONGUE GROUNDING STRUCTURE OF CONNECTOR

(75) Inventor: Kuan-Hsiung Wei, Taipei (TW)

(73) Assignee: Shyh-Chang Chiu, Taipei (TW)

( * ) Notice: Subject to any disclaimer, the term of this patent is extended or adjusted under 35 U.S.C. 154(b) by 0 days.

(21) Appl. No.: 12/949,796

(22) Filed: Nov. 19, 2010

(51) Int. Cl.
*H01R 13/60* (2006.01)

(52) U.S. Cl. ..... 439/540.1; 439/607.26; 439/607.38

(58) Field of Classification Search ..... 439/540.1, 439/607.23–607.26, 607.35
See application file for complete search history.

(56) References Cited

U.S. PATENT DOCUMENTS 6,183,300 B1 * 2/2001 Belopolsky et al. ..... 439/607.4
7,883,369 B1 * 2/2011 Sun et al. ..... 439/607.35
7,988,495 B2 * 8/2011 Chung ..... 439/660
2002/0086581 A1 * 7/2002 Chen et al. ..... 439/607
2005/0059295 A1 * 3/2005 Chen et al. ..... 439/540.1
2011/0111629 A1 * 5/2011 Peng et al. ..... 439/607.35

* cited by examiner

*Primary Examiner* — Hien Vu
(74) *Attorney, Agent, or Firm* — Leong C. Lei

(57) ABSTRACT

A tongue grounding structure is provided for a connector. The connector includes a connector body, at least one circuit board, and a metal shell. The circuit board is received in the connector body. The circuit board includes conductive traces formed thereon. The conductive traces are extended to form a contact point. The metal shell encloses the connector body, and includes at least one clamping section extending therefrom. The clamping section includes a first clamp plate and a second clamp plate. With the above described arrangement, to assemble the connector, the clamping section is set to resiliently clamp the contact point of the circuit board received in the connector body in order to realize electrical connection between a grounding wire and the metal shell.

3 Claims, 5 Drawing Sheets

TONGUE GROUNDING STRUCTURE OF CONNECTOR

(a) TECHNICAL FIELD OF THE INVENTION

The present invention generally relates to a grounding structure, and more particularly to a tongue grounding structure of connector that has a simple structure and reduced costs.

(b) DESCRIPTION OF THE PRIOR ART

With the development of science and technology, various electrical and electronic appliances are widely used in the living of human beings. Every electrical or electronic appliance requires a grounding structure for the appliance. The grounding structure provides three purposes, which are electrical shock protection, actuation protection, and fire and explosion protection.

For an electrical or electronic device that has been used for a long time, electricity leakage or excessively high potential or excessively accumulated charges on a non-metal portion due to electrical induction, if not properly discharged through a suitable channel, may cause electrical shock to a person contacting the portion. A grounding structure provides a low resistance circuit that serves as means for electrical current protection. Further, grounding also provide a sufficient capacity for carrying current so that a malfunctioning circuit may induce electricity leakage due to excessively high resistance.

Thus, every electrical or electronic device must be provided with a grounding structure. Electricians must have professional knowledge of grounding structure in installing electrical or electronic appliances.

The known grounding structure, however, shows drawbacks that must be improved:

A known grounding structure comprises a grounding wire that is additionally and electrically connected to a circuit board, and electrical connection can be made to a metal shell of an electronic device through the grounding wire to realize grounding. However, the known grounding structure must include such a conductor wire extending therefrom to realize electrical connection. Such a grounding structure is not sufficiently stable, and may get falling. Improvement is thus required.

Thus, it is desired t have a solution in the industry to solve such a problem.

SUMMARY OF THE INVENTION

In view of the above discussed problems, the present invention aims to provide a tongue grounding structure for connector that has a simple structure and reduced costs.

An objective of the present invention is to provide a grounding structure that has a simple structure and effectively reduces costs.

To achieve the above objective, the present invention provides a connector that comprises a connector body, at least one circuit board, and a metal shell. The connector body comprises at least one connection port. The circuit board is received in the connector body. The circuit board comprises conductive traces formed thereon, and the conductive traces are extended to form a contact point. The metal shell encloses the connector body. The metal shell comprises at least one clamping section extending therefrom. The clamping section comprises a first clamp plate and a second clamp plate. The clamping section uses the first clamp plate and the second clamp plate to resiliently clamp the contact point of the circuit board.

Since the circuit board according to the present invention forms conductive traces and since the conductive traces are extended to form a contact point, in the design of circuit, a grounding wire may be set in electrical connection with the conductive traces. Further, due to the metal shell of the present invention comprising at least one clamping section that comprises a first clamp plate and a second clamp plate, when a user is assembling the connector according to the present invention, the clamping section can be used to resiliently clamp the contact point of the circuit board, simultaneously realizing grounding connection for the circuit board of the connector. With such a structure, the present invention may realize grounding effect through a simple structure, so that at the time when a user assembles a connector, a grounding structure is simultaneously established.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
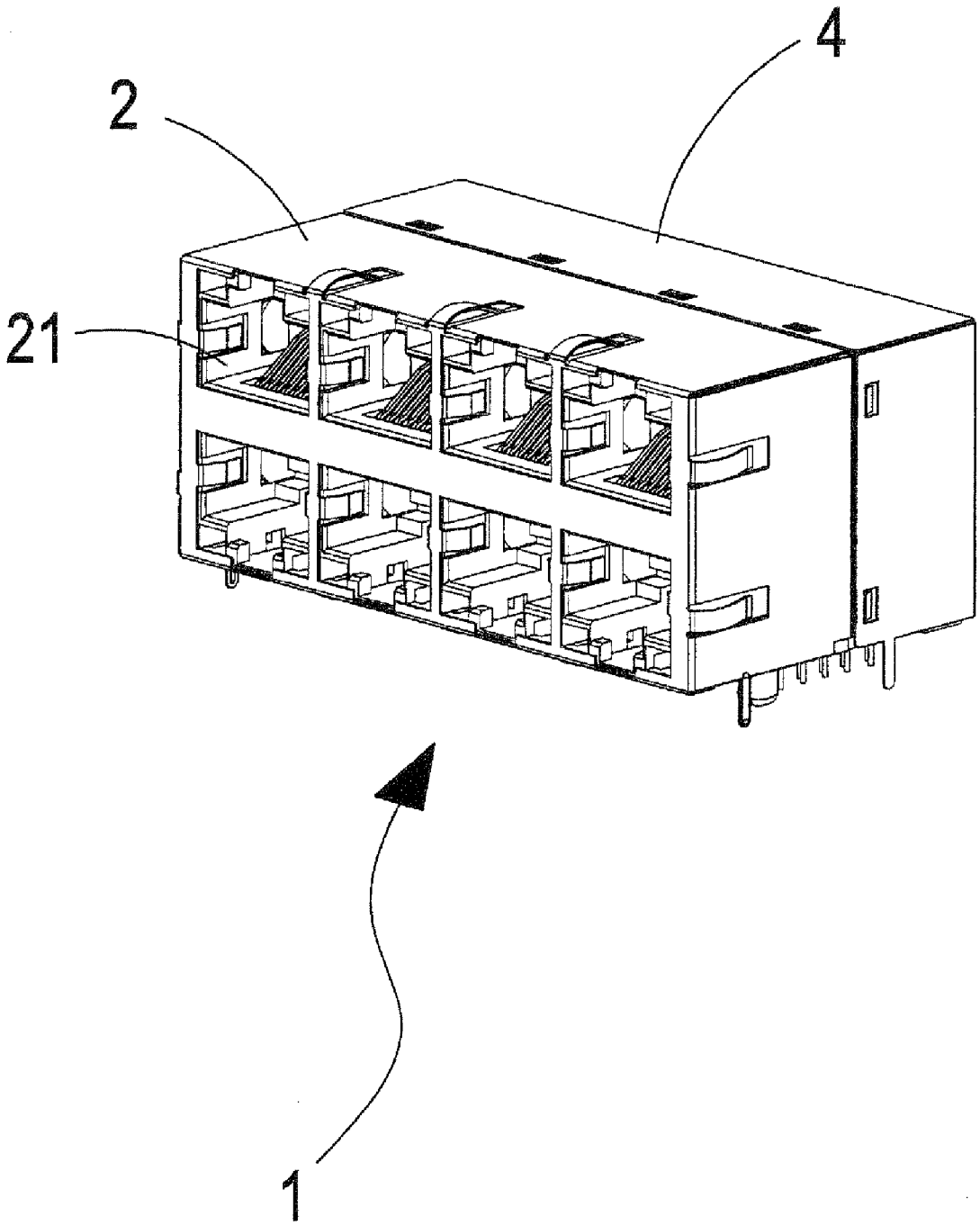
FIG. 1 is a perspective view showing a preferred embodiment according to the present invention.
Figure 2:
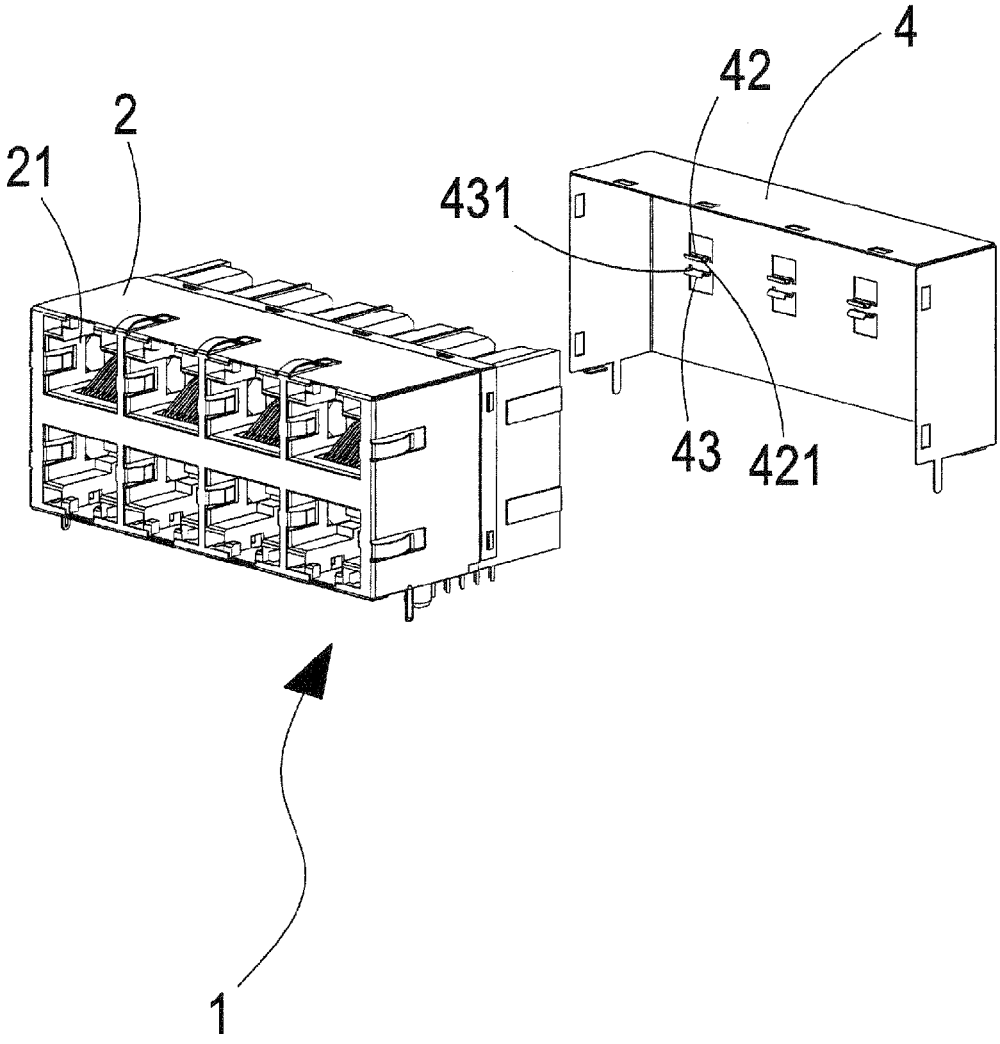
FIG. 2 is an exploded view of the preferred embodiment according to the present invention.
Figure 3:
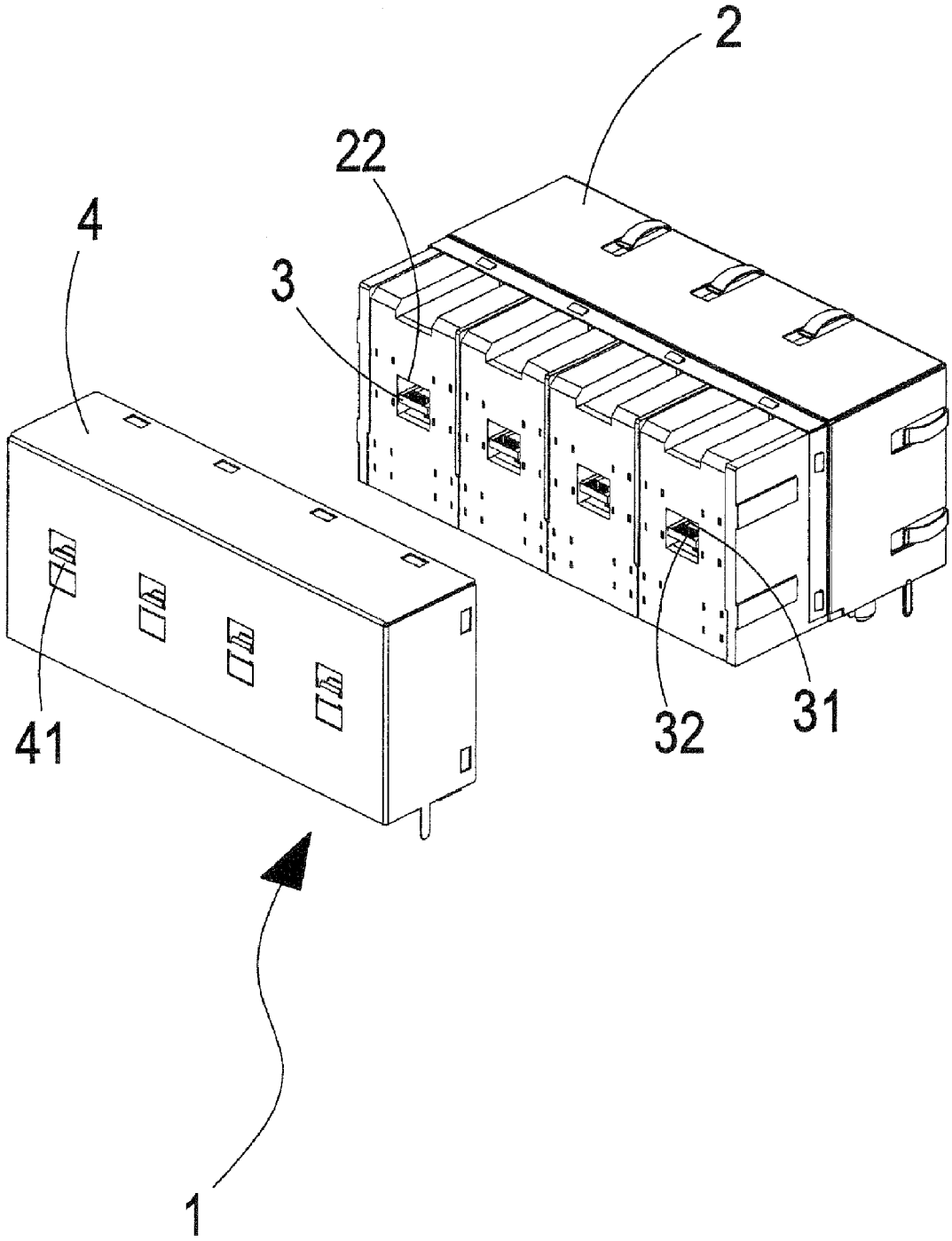
FIG. 3 is another exploded view of the preferred embodiment according to the present invention.
Figure 4:
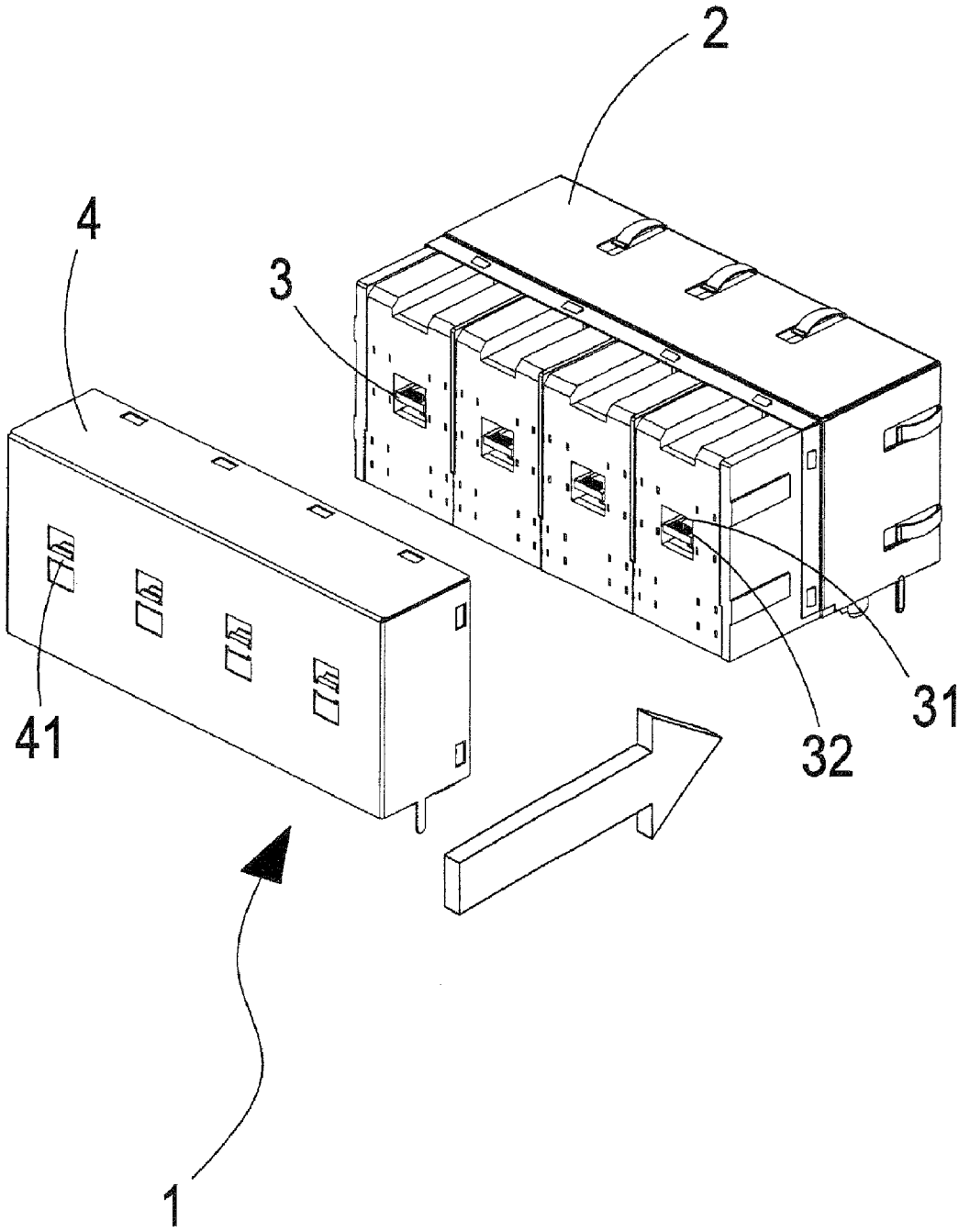
FIG. 4 is a perspective demonstrating assembling operation of the preferred embodiment of the present invention.
Figure 5:
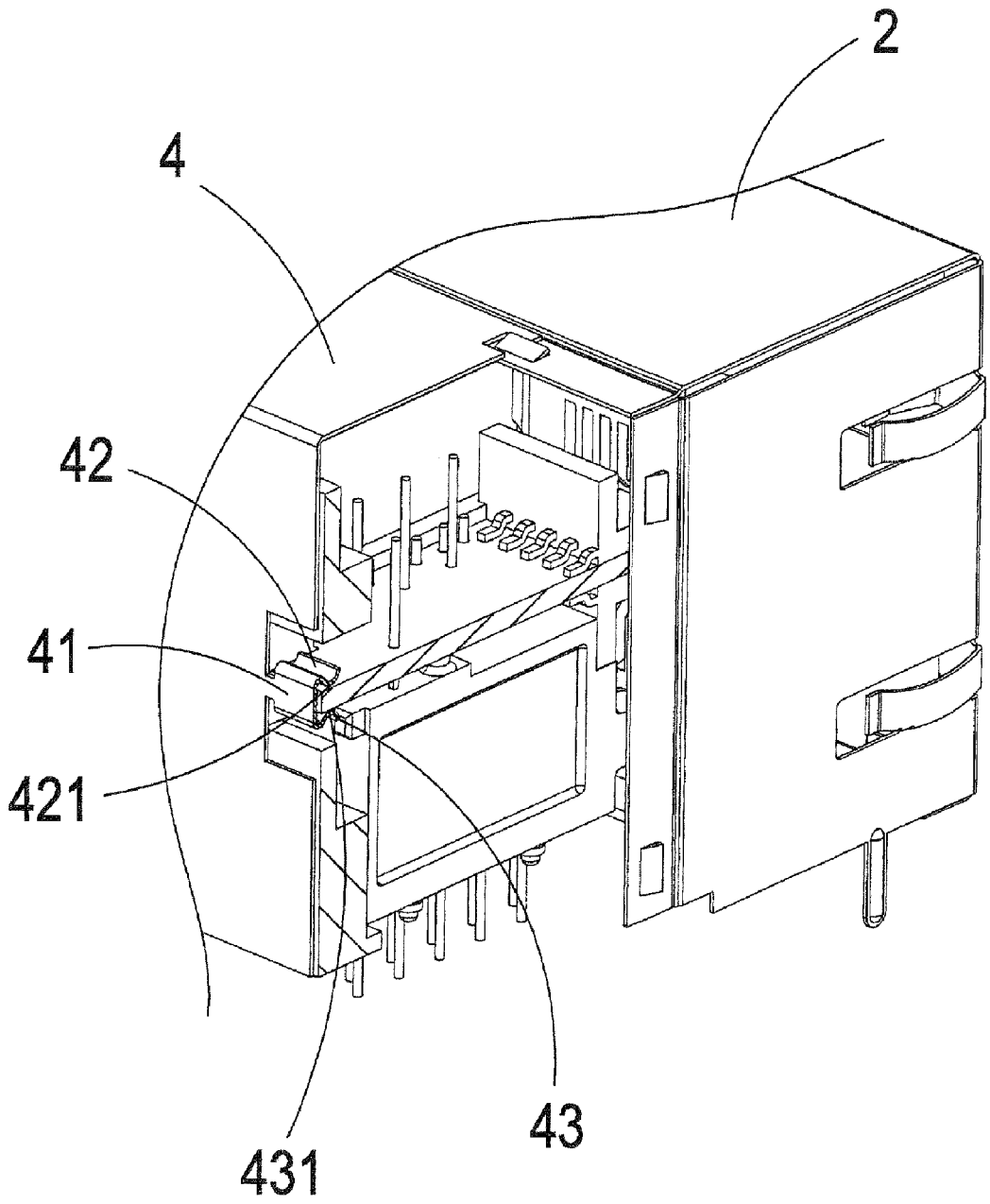
FIG. 5 is another perspective demonstrating assembling operation of the preferred embodiment of the present invention.

Referring to FIGS. 1, 2, and 3, which are respectively a perspective view and two exploded views of a preferred embodiment according to the present invention, these drawings clearly show that a connector 1 according to the present invention comprises the following components/parts:

A connector body 2 comprises at least one connection port 21. The connector body 2 forms an opening 22.

At least one circuit board 3 is received and retained in the connector body 2. The circuit board 3 comprises conductive traces 31 formed thereon and the conductive traces 31 are extended to form a contact point 32.

A metal shell 4 encloses the connector body 2. The metal shell 4 comprises at least one clamping section 41 extending therefrom. The clamping section 41 comprises a first clamp plate 42 and a second clamp plate 43. The clamping section 41 uses the first clamp plate 42 and the second clamp plate 43 to resiliently clamp the contact point 32 of the circuit board 3. The first clamp plate 42 and the second clamp plate 43 are each curved to form an engagement portion 421.

With the above described arrangement and structure, the operation of the present invention will be described as follows. References are made to FIGS. 2, 3, 4, and 5, which are respectively two exploded views of the present invention and two perspective views demonstrating assembling operation of the present invention. These drawings clearly show that since the connector 1 of the present invention comprises a circuit board 3 that forms conductive traces 31, and the conductive traces 31 are extended to form a contact point 32, in the design of circuit, a grounding wire may be set in electrical connection with the conductive traces 31, and in assembling the connector 1 according to the present invention, due to the metal shell 4 of the present invention comprising at least one clamping section 41 that comprises a first clamp plate 42 and a second clamp plate 43, the metal shell 4 can use the clamping section 41 to resiliently clamp the contact point 32 of the circuit board 3 received in the connector body 2. Thus, with such a structure, at the time when a user assembles the connector 1, electrical connection between the grounding wire and the metal shell is realized at the same time, so that there is no need to arrange an additional grounding line, and a structure of connector 1 that has a simple structure and reduced costs is provided.

The first clamp plate 42 and the second clamp plate 43 are each curved to form an engagement portion 421, 431 in order to increase a force induced by elastic deformation of the clamping section 41.

With a proper construction of what described above and shown in the attached drawings, the present invention, when put into practice, shows the following advantages as compared to the known technology:

The present invention comprises a metal shell 4 that comprises at least one clamping section 41 extending therefrom, whereby in assembling the connector 1, the clamping section 41 can be used to clamp and electrically engage the contact point 32 arranged in the connector body 2 to save the arrangement of the conventional grounding wire. With such a structure, the connector 1 of the present invention realizes practical advantages of structure simplification and cost reduction.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A tongue grounding structure of connector, the connector comprising:

a connector body, which comprises at least one connection port;

at least one circuit board, which is received in the connector body, the circuit board comprising conductive traces formed thereon, the conductive traces being extended to form a contact point; and a metal shell, which encloses the connector body, the metal shell comprising at least one clamping section extending therefrom, the clamping section comprising a first clamp plate and a second clamp plate that are arranged at opposite surfaces of the circuit board, the clamping section independently securing the circuit board in position by using the first clamp plate and the second clamp plate to resiliently engage the opposite surfaces of the circuit board and clamp the contact point of the circuit board therebetween.

2. The tongue grounding structure of connector according to claim 1, wherein the first clamp plate and the second clamp plate are curved toward each other to form engagement portions, whereby the first and second clamp plates engage the circuit board with the engagement portions thereof at the opposite surfaces of the circuit board.

3. The tongue grounding structure of connector according to claim 1, wherein the connector body forms an opening.

* * * * *